United States Patent [19]

Embree

[11] Patent Number: 4,902,165

[45] Date of Patent: Feb. 20, 1990

[54] LOCKING VALVE COVER

[76] Inventor: Lewis A. Embree, 338 Atwood St., Longmont, Colo. 80501

[21] Appl. No.: 157,912

[22] Filed: Feb. 19, 1988

[51] Int. Cl.[4] ..... B65D 55/14; E02D 29/14

[52] U.S. Cl. ..... 404/25; 404/72

[58] Field of Search ..... 404/25, 26, 72; 49/35, 49/41, 465; 220/210; 292/7; 70/163–169, 231

[56] References Cited

U.S. PATENT DOCUMENTS

| | | | |
|---|---|---|---|
| 822,562 | 6/1906 | Tucker | 49/465 X |
| 845,182 | 2/1907 | Letts | 70/168 |
| 1,204,464 | 11/1916 | Lofton | 404/25 X |
| 1,287,290 | 12/1918 | Golden | 49/35 |
| 1,400,399 | 12/1921 | Yaeche | 49/35 X |
| 1,458,391 | 6/1923 | Burton | 404/25 X |
| 1,903,765 | 4/1933 | Johnson | 70/165 X |
| 2,363,567 | 11/1944 | Blakeman | 404/25 X |
| 3,098,376 | 7/1963 | Miller | 70/333 |
| 3,339,384 | 9/1967 | Greenwald | 70/363 |
| 3,383,885 | 5/1968 | Epstein | 70/167 |
| 3,473,355 | 10/1969 | Saito | 70/339 |
| 3,473,356 | 10/1969 | Niilola | 70/360 |
| 3,772,828 | 11/1973 | Chahley | 49/465 |
| 3,797,286 | 3/1974 | Saporito | 70/169 |
| 4,064,720 | 12/1977 | Fry | 70/363 |
| 4,493,199 | 1/1985 | Uyeda | 70/333 |
| 4,577,478 | 3/1986 | Economopoulos et al. | 70/168 |

*Primary Examiner*—Jerome W. Massie, IV
*Assistant Examiner*—Matthew Smith
*Attorney, Agent, or Firm*—James R. Young

[57] ABSTRACT

A rotatable driver cup rotatably mounted in the top plate of a valve box cover or manhole cover with the open top of the cup opening above the top plate and the rest of the cup extending downwardly through a hole in the top plate to a position thereunder, a cup-shaped crank positioned concentrically around the portion of the driver cup that extends below the top plate, but the crank is too large to be pulled up through the hole. The driver cup and the crank are connected together so that they are axially immovable in relation to each other, but such that the driver cup can normally rotate freely in the crank. There are radially aligned apertures in both the driver and the crank, and a lock mechanism, such as a key and tumbler pin type cylinder lock, is positioned in the cup-shaped driver with a lock-actuated, radially extendable and retractable, tongue that can protrude through both apertures in the driver and the crank to engage the driver and crank together. When so engaged, the rotation of the driver will rotate the crank. However when no so engaged, rotation of the driver from above the top plate will not rotate the crank below the plate.

23 Claims, 7 Drawing Sheets

LOCKING VALVE COVER

BACKGROUND OF THE INVENTION

1. Field of the Invention

The present invention relates to protective covers for valves and manholes, and more specifically to a method and apparatus for securing valves and manholes by means of a locking cover.

2. Description of Prior Art

The general principles of locking doors, hatches, and vaults are widely known. Many designs use the principle of locking rods or bolts being moved radially into or out of a locking position by some rotating, lever, or gear drive mechanism. Some designs include the use of a keyed cylinder, combination lock, or timer mechanism, or a combination of all in order to secure the locking rods or bolts into position. The application of such devices has extended to safe doors, bank vault doors, ship hatches, aircraft hatches, and the like.

Yet one application in which there has been a need for decades for a practical, reliable method and apparatus for securing access has been that of valve covers, manhole covers, and cover plates for boxes, pits, and vaults. Wherever valves exist that can be manually turned and that can be accessed by persons who have no valid reason to turn them, or vaults containing sensitive equipment, there is a need for a locking valve cover. Wherever access to conduits such as sewer or storm drain pipes, underground communications lines, electric junctions, natural gas main controls, or the like is available through manholes, valves, above or below-ground buildings or vaults, a locking cover can provide necessary security.

By way of example, community water main valves are frequently buried underground, with access provided to them by a shroud that extends from the underground conduit to the surface. The opening of the shroud is covered by a small, usually round, cast iron cover that can be removed by a prying tool, or even by a person's fingers. Access points to these valves are frequently found in public places, such as on streets or sidewalks. Electrical and telephone cables are frequently located in underground pipes or conduits, with access provided by manhole. The manhole access is usually secured by a cast iron cover. Storm drains and sewer systems are similarly accessed.

There have been some previous lockable manhole covers devised. However, until the development of the present invention, no relatively inexpensive, weatherproof, convenient, reliable, and easy to assemble device that would provide security for the widespread, already-installed underground conduit systems, as well as future systems, has existed.

SUMMARY OF THE INVENTION

Accordingly, it is a general object of the present invention to provide a new and improved method and apparatus for locking and securing valve access points, manholes, and the like that is easily adaptable to commonly existing valve housings and manhole fittings.

Further, it is a general object of the present invention to provide a new and improved method and apparatus for locking and securing valve access points, manholes, and the like that will function in a multiplicity of weather conditions and be relatively impervious to the effects of exposure.

A specific object of the present invention is to provide a method and apparatus for securing valve access points and manholes that provides easy access when properly unlocked, but that resists unauthorized opening.

A more specific object of the present invention is to provide a method and apparatus for securing valve access points and manholes that is easily accessible by authorized agencies, but that is not accessible by agencies operating similar systems.

It is also a specific object of the present invention to provide a method and apparatus for securing valve access points and manholes that is easily accessible to authorized regional emergency response agencies, though belonging to and being operated by separate authorities.

Still another specific object of this invention is to provide a method and apparatus of securing valve access points and manholes that is keyed and that is integral to the cover of the access point/manhole.

It is yet another specific object of the present invention to provide a design by which existing valve covers and manhole covers could be retrofitted, providing security at a reduced cost over requiring installation of a complete new system.

Additional objects, advantages, and novel features of the present invention shall be set forth in part in the description that follows, and in part will become apparent to persons skilled in the art upon examination of the following or may be learned by the practice of the invention. The objects and advantages of the invention may be realized and attained by means of the instrumentalities and in combinations particularly pointed out in the appended claims.

To achieve the foregoing and other objects and in accordance with the purpose of the present invention as embodied and broadly described herein, the apparatus of this invention may comprise a rotatable driver cup rotatably mounted in the top plate of a valve box cover or manhole cover with the open top of the cup opening above the top plate and the rest of the cup extending downwardly through a hole in the top plate to a position thereunder, a cup-shaped crank positioned concentrically around the portion of the driver cup that extends below the top plate, but the crank is too large to be pulled up through the hole. The driver cup and the crank are connected together so that they are axially immovable in relation to each other, but such that the driver cup can normally rotate freely in the crank. There are radially aligned apertures in both the driver and the crank, and a lock mechanism, such as a key and tumbler pin type cylinder lock, is positioned in the cup-shaped driver with a lock-actuated, radially extendable and retractable, tongue that can protrude through both apertures in the driver and the crank to engage the driver and crank together. When so engaged, the rotation of the driver will rotate the crank. However when not so engaged, rotation of the driver from above the top plate will not rotate the crank below the plate. The tongue of the cylinder lock, however, cannot be withdrawn from the driver, so the cylinder lock cannot be removed. Radially extendable and retractable locking bolts or lugs are connected to the crank in such a manner that the crank, when rotated, causes the lugs to extend and retract radially to engage and disengage a collar on the valve box. When the lugs are extended, the valve box cover cannot be removed from the valve box. A bevel on the distal ends of the lugs allow the lugs to be retracted while rotating the crank one direction, but lack of such a bevel on the other side of the lug causes binding of the lugs, thus inhibiting their retraction and over-rotation of the crank in the other direction.

To further achieve the foregoing and other objects and in accordance with the purposes of the present invention, the method of the invention may comprise the steps of engaging a locking lug cam actuator and a locking lug cam by extending the tongue of a cylinder lock through an aperture in each, and rotating said cam actuator so that said cam rotates in the same direction. Rotating the cam actuator in one direction extends the locking lugs through the side walls of the valve cover so that the lugs engage the valve cover receptacle; rotating the cam actuator in the opposite direction retracts the lugs so that they disengage the valve cover receptacle. The method also includes the steps of disengaging the locking cam actuator and the locking cam by retracting the tongue of the cylinder lock so that the cylinder lock tongue no longer engages the aperture in the locking lug cam, and rotation of the locking lug cam actuator no longer rotates the locking lug cam. The method therefore includes the steps of extending the cylinder lock tongue through the apertures of both the locking cam actuator and the locking cam and rotating both so as to extend the locking lugs; then retracting the cylinder lock tongue while the locking lugs are in the extended position, engaging the valve receptacle, to accomplish locking; and extending the cylinder lock tongue through the apertures of both the locking cam actuator and the locking cam and rotating both so as to retract the locking lugs so that they no longer engage the valve receptacle, to accomplish unlocking.

DESCRIPTION OF THE DRAWINGS

The accompanying drawings, which are incorporated in, and form a part of, the specification illustrate the preferred embodiments of the present invention, and together with the description serve to explain the principles of the invention. In the drawings.

DETAILED DESCRIPTION OF THE PREFERRED EMBODIMENTS

Figure 1:
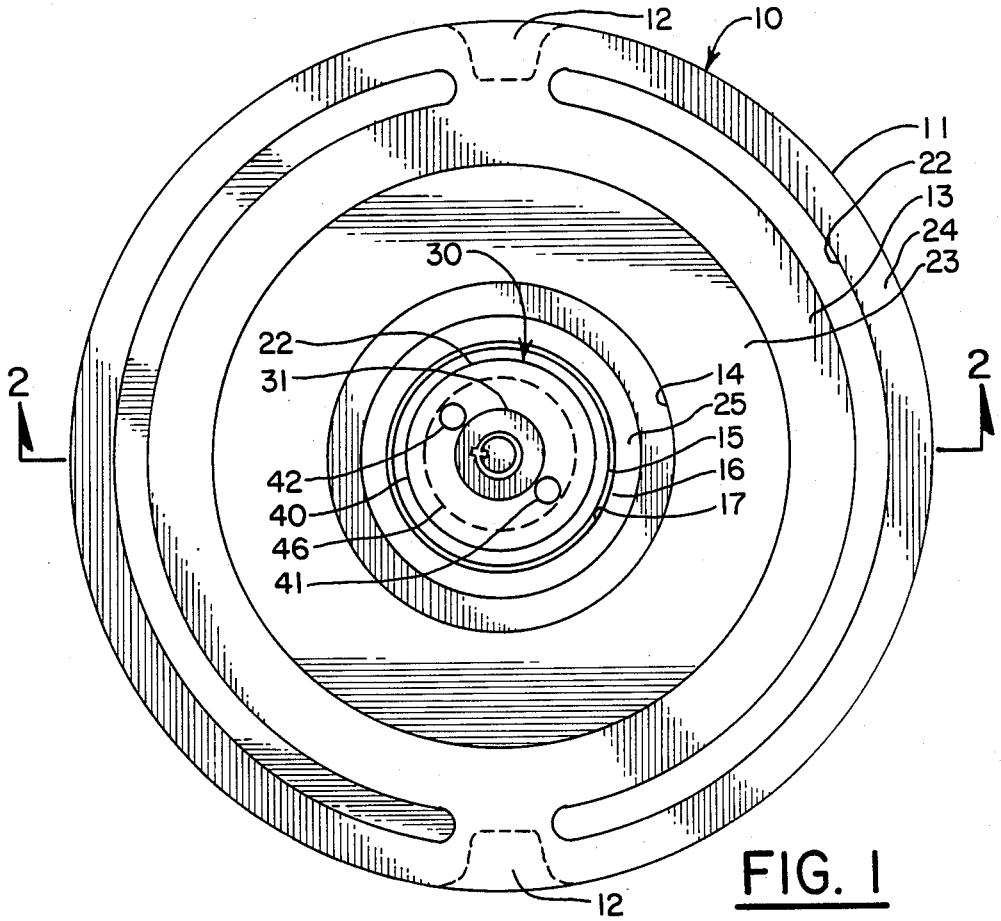
FIG. 1 is a top plan view of the locking valve cover showing the keyed lock cylinder, the pivot tool receptacles, and the locking mechanism.

A preferred embodiment of a locking valve cover device, according to the principles of, and to facilitate the practice of, the present invention is shown in FIGS. 1-8. The principles of the operation of the locking valve cover will be described in more detail below. However, for purposes of a general description of the major components, the locking valve cover device 10 according to FIGS. 1 and 2 has a valve cover body 11 of an essentially standard or conventional configuration, comprising an upper ring portion 19, a lower ring portion 20, an annular shoulder or seat portion 18 at the juncture of the upper and lower side portions 19 and 20, a top plate portion 13, and recessed lifting points 12.

Figure 2:
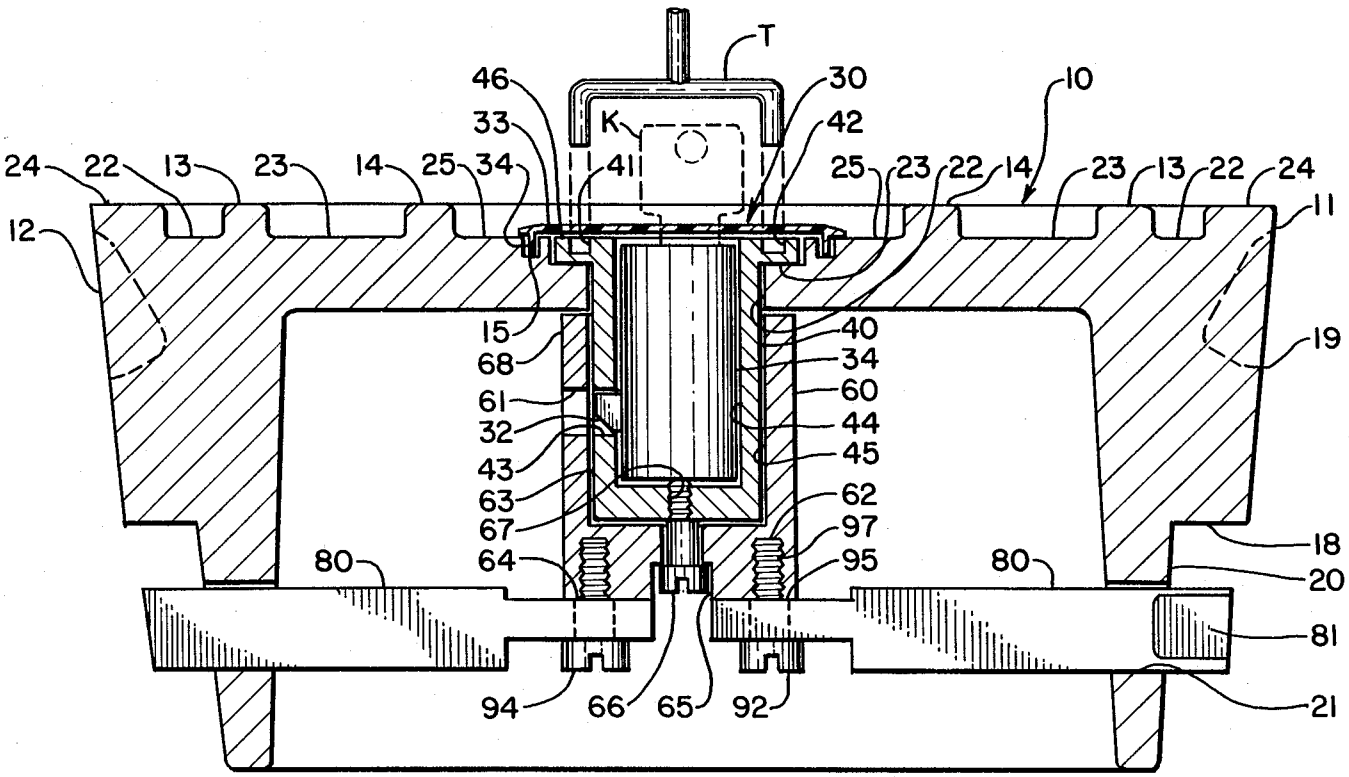
FIG. 2 is a side cross sectional view of the locking valve cover taken essentially along lines 2—2 of FIG. 1 and showing its cylinder lock tongue retracted and disengaged from the locking lug cam and the locking lugs extended, so that the valve cover is in a locked and secure configuration.

A lock mechanism 30 according to the present invention is also shown in FIGS. 1 and 2. The top plate portions 13 and 24 of valve cover body 11 may be raised and patterned for reinforcement or for weight, and areas 22 and 23 may be lowered for material bulk reduction. However, a top plate raised center portion 14, as shown in FIG. 1, is provided to prevent accidental dislodgement of a weather protective cap 33 as shown in FIG. 2. Top plate surface 25 according to FIGS. 1 and 2 contains an annular groove 15 for retention of the weather-protective cap 33, and a central hole 22 with a widened shoulder portion 23 for mounting lock mechanism 30. The raised portion 14 in combination with lowered surface 25 and shoulder portion 23 also serve to protect lock mechanism 30. Side walls, for example comprising the downwardly extending lower ring portion 20 of valve cover body 11, as shown in FIG. 2, or any other suitable structure or structures extending downwardly from the top plate 13, has four locking lug retaining holes 21, which are preferably spaced equidistantly about its perimeter.

As shown in FIG. 2, lock mechanism 30 is comprised of a keyed lock cylinder 31 having a projecting lock tongue 32 positioned in a cylindrical rotor cup or driver 40. The rotor cup 40 extends through hole 22 in top plate portion 13, and it is supported by the shoulder 23 bearing on a radially extending annular flange 46 around the uper end of rotor cup or driver 40. The rotor cup 40 is rotatably positioned in a cylindrical crank 60, which has a closed bottom portion 64 in which four threaded holes 62 are equidistantly spaced. A shouldered central hole 65 extends axially through the bottom hole in axial alignment with a threaded hole 67 in the bottom of rotor cup 40.

Four locking lugs 80 with beveled lateral surfaces 81 adjacent their distal ends, are rotatably attached at their proximal ends to crank 60 by four shoulder bolts 90, 91, 92, 93 that are screwed into holes 62 by their threaded shanks 97. The crank 60 is rotatably attached to rotor cup 40 by a locking lug cam retainer bolt 66 screwed into hole 67. When assembled in this manner, the entire lock assembly 30 is retained in the valve cover body 11 against extraction by the top end 68 of cylindrical crank 60 that is too large to pass through the hole 22 in top plate surface 25.

The locking mechanism 30 is protected from exposure to weather and dirt by resilient cap 33. This cap 33 has a retention ring portion 34 that fits snugly into the cap retention groove 15 of valve cover body 11.

Keyed lock cylinder 31 can be actuated by any conventional lock mechanism, such as a tumbler pin and key mechanism, or by more high security combination locks, magnetic locks, electric locks, or other types of lock mechanisms, all of which are standard and well-known. Therefore, no attempt is made here to describe any particular actuator mechanism for the lock cylinder 31 beyond operation of tongue 32. Suffice it to say for the purposes of this description that the lock cylinder 31 can be accessed and operated from above the top plate 13 by an appropriate key K (shown in phantom lines in FIG. 2 and in solid lines in FIG. 3) will extend or retract tongue or latch 32, which is spring-biased to remain at least partially extended.

Referring still to FIG. 2, rotor cup 40 has an inner chamber 44 that is sized so that lock cylinder 31 can fit snugly, but not tightly, within it, and it is of sufficient depth to fully contain lock cylinder 31. Rotor cup 40 also has an aperture 43 in radial alignment with tongue or latch 32. Tongue 32, when in the retracted position, projects into aperture 43 but not beyond it, so that lock cylinder 31 is retained in place. Spring tensioning of lock cylinder tongue 32 allows it to be manually pressed into the lock cylinder 31 and out of aperture 43 so that lock cylinder 31 may be extracted for replacement if necessary. However, since there is no access to aperture 43 or tongue 32 from above cover 10, it must be unlocked and removed in order to extract lock cylinder 31 from its nest in rotor cup 40. Flange portion 46 of rotor cup 40 also has pivoting tool receptacles 41 and 42 drilled into its top, exposed surface for receiving a tool T suitable for rotating rotor cup 40 after the key K has been used to actuate the lock cylinder 31 when the cover 10 is to be unlocked as will be described in more detail below.

Cylindrical crank 60 according to FIG. 2 has an inner chamber 63 into which rotor cup 40 fits with just sufficient clearance to allow free rotation of rotor cup 40 in chamber 63. Crank 60 also has an aperture 61 of the same size and shape as aperture 43 of locking cam actuator 40, and positioned so that lock cylinder tongue 32 will engage both aperture 61 and aperture 43 when they are in radial alignment and tongue 32 is fully extended. In this condition, crank 60 can be rotated with rotor cup 40 when rotor cup 40 is rotated either by a key K in lock cylinder 31 or by a pivoting tool T engaged with 41 and 42. When tongue 32 is retracted from and disengages aperture 61, however, crank 60 will not be rotated by rotation of rotor cup 40, but will remain stationary instead. Therefore, crank 60 can only be rotated when tongue 32 protrudes into aperture 61 of crank 60, which protrusion can only be effected by key K in lock cylinder 31.

Crank 60 is retained in axially immovable, but rotatable relation to rotor cup 40 by shoulder retainer bolt 66. Retainer bolt 66 is recessed into hole 65 in order not to interfere with rotation or movement of locking lugs 80.

Figure 3:
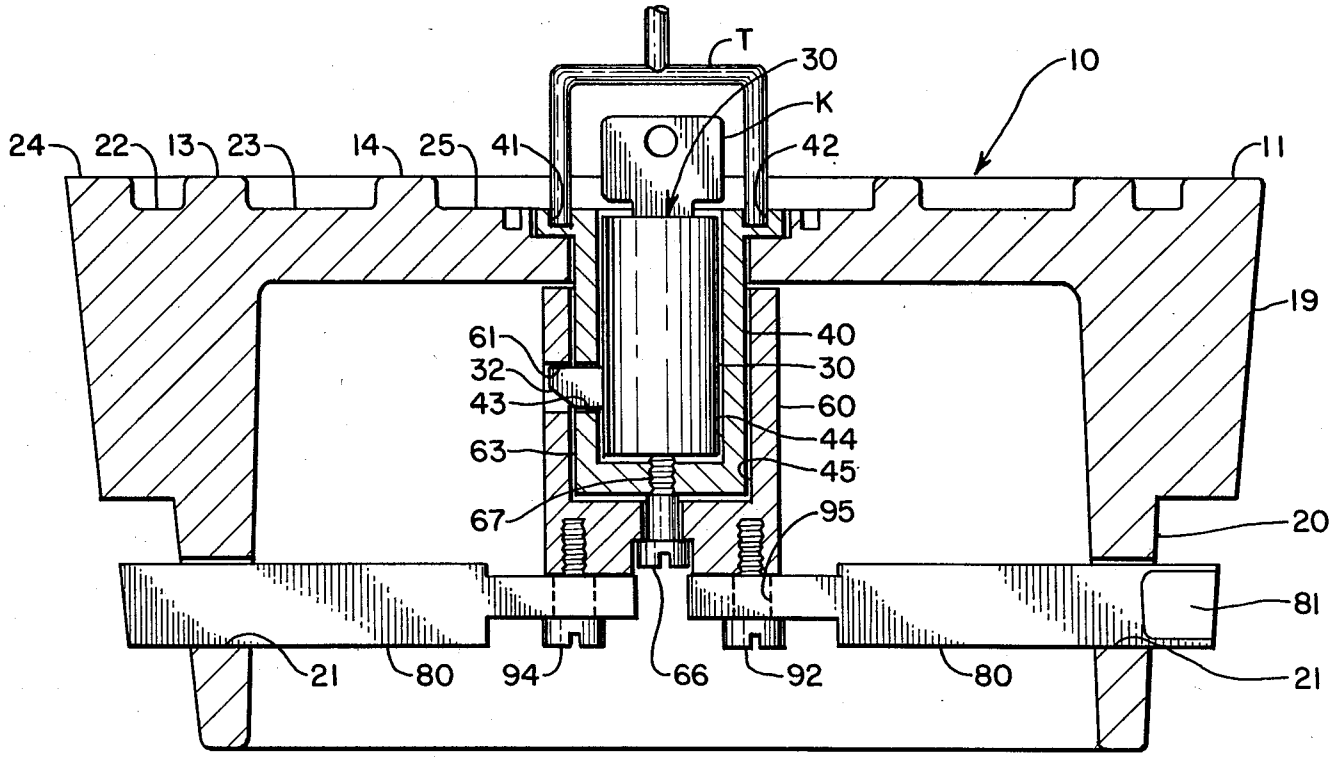
FIG. 3 is a side cross sectional view of the locking valve cover showing its cylinder lock tongue extended and engaging the locking lug cam so that rotation of the locking bolt cam actuator will retract the locking lugs.
Figure 4:
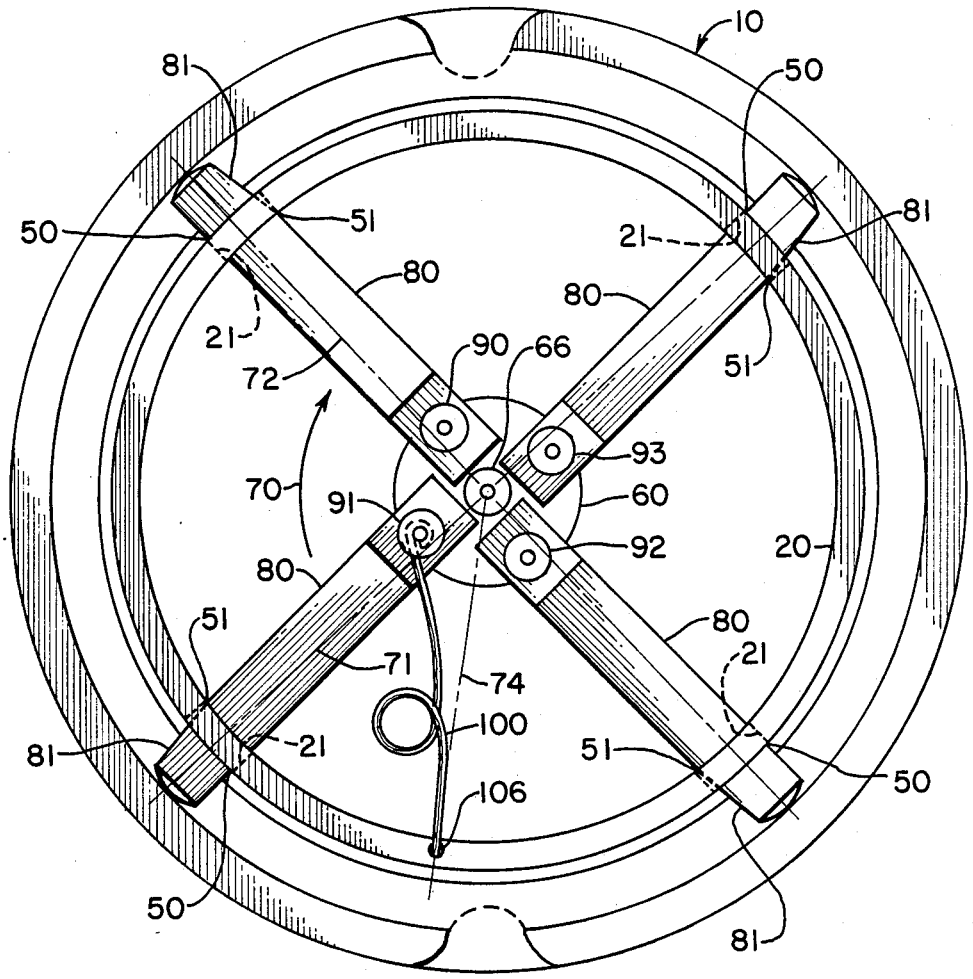
FIG. 4 is a bottom plan view of the locking lug mechanism in the locked (extended) position.
Figure 5:
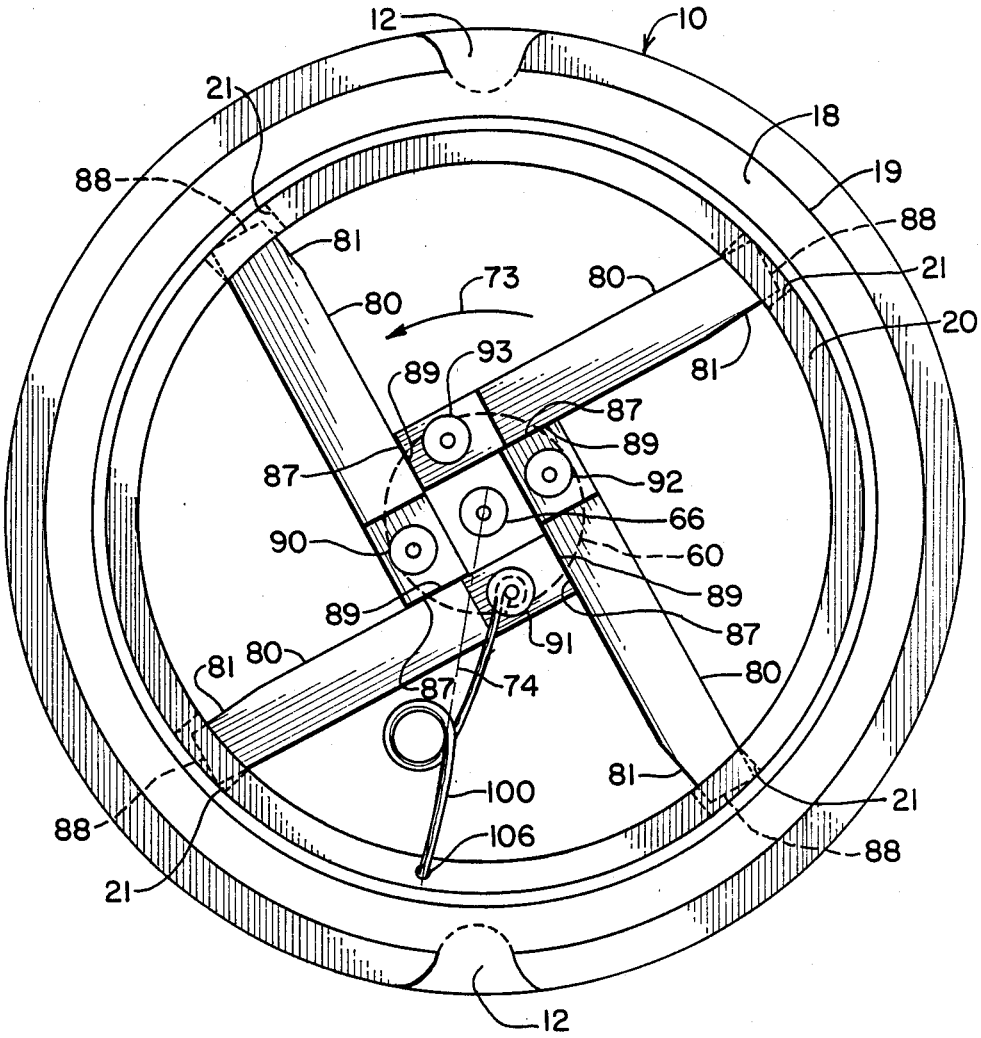
FIG. 5 is a bottom plan view of the locking lug mechanism in the unlocked (retracted) position.

Locking lugs 80 are connected to crank 60 at threaded holes 62 by retaining bolts 90, 91, 92, 93, as shown in FIGS. 2–5. The shoulder portion 95 of retaining bolt 91 must be slightly longer than shoulder portions 95 of retaining bolts 90, 92, 93 in order to accommodate the thickness of overcentering spring 100, which is shown in FIGS. 4 and 5. Locking lugs 80 are free to rotate about the shoulder portions 95 of retaining bolts 90, 91, 92, and 93.

Figure 8A:
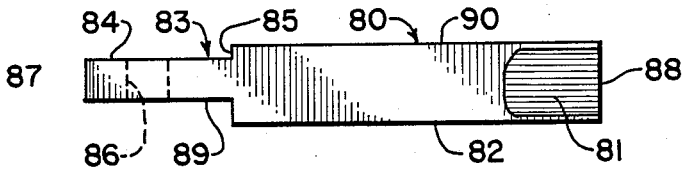
FIG. 8*a* and 8*b* are detailed elevation and plan views of a typical locking lug according to this invention.
Figure 8B:
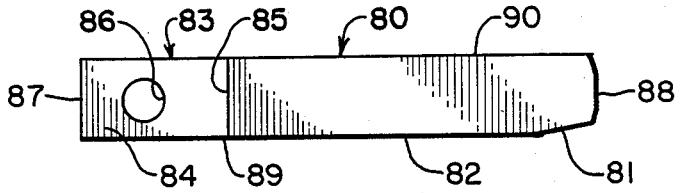

Locking lugs 80, as shown in FIGS. 8*a* and 8*b*, are preferably in the form of solid, elongated, shafts 82, each of which has a flat proximal end 87 and a slightly rounded distal end 88. Each lug 80 also has a flattened shank portion 83 with a mounting hole 86 extending therethrough that is slightly larger in diameter than the diameter of shoulders 95 of retaining bolts 90, 91, 92, 93. The upper surface 84 of shank portion 83 is recessed below the peripheral surface of shaft 82 so as to form a shoulder 85. Shank portion 83 also has a contact 89 on one of its lateral sides. An angled or bevelled face 81 is provided near distal end 88 in a plane that is perpendicular to the plane of surface 84. As best seen in FIGS. 4 and 5, locking lugs 80 are attached to crank 60 by retaining bolts 90, 91, 92, 93 extending through holes 86, and with upper surface 84 of shank 83 in contact with crank 60, and they are held in position near their distal ends by projecting into holes 21 in lower ring portion 20 of valve cover body 11.

Figure 6:
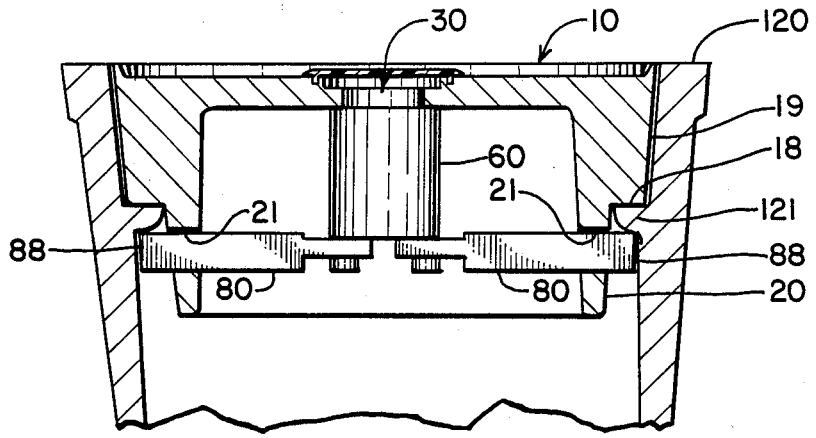
FIG. 6 is a side cutaway view of the locking valve cover in a typical valve receptacle, showing the locking lug engagement of the valve receptacle.

When viewed from the bottom, such as in FIG. 4, locking lugs 80 are in their fully extended position with distal ends 88 extending through holes 21 and past the outer perimeter of lower ring 20 when crank 60 is rotated in the direction indicated by arrow 70. The coiled overcentering spring 100, with its one end anchored in hole 106 in ring 20 and its other end anchored on a retainer bolt 91, tends to resist rotation in the direction of arrow 70 at first until bolt 91 passes over the line 74 extending between the center of rotation at bolt 66 and the anchor point 66. After that, spring 100 actually pushes rotation so that the bolt 91, 93 pass "over center" with respect to center line 71 and bolts 90,92 pass "over center" with respect to center line 72. Beyond that "over center" point, spring 100 continues to bias crank 60 of arrow 70. However, over-rotation of crank 60 in the extending direction, which could result in unwanted retraction of lugs 80, is limited and prevented by action of the lugs 80 binding up between respective points 50, 51 with the ring 20 at the corners of holes 21. Once the lugs 80 go into this bind between points 50, 51, further rotation in the direction of arrow 70 is prohibited, and reverse rotation back "over center" the other way is resisted by spring 100, so the lugs 80 remain extended in this locked position shown in FIG. 4. In this fully extended position, distal ends 88 extend far enough past lower ring 20 to engage the valve cover seat 121 collar of valve box 120, as shown in FIG. 6. Most standard valve boxes 120, as well as most standard man holes, have this kind of valve cover seat collar 121 for the locking lugs 80 to engage. With the distal ends 88 positioned under the valve cover 121, the valve cover device 10 cannot be removed, thus it is locked in place.

Figure 7:
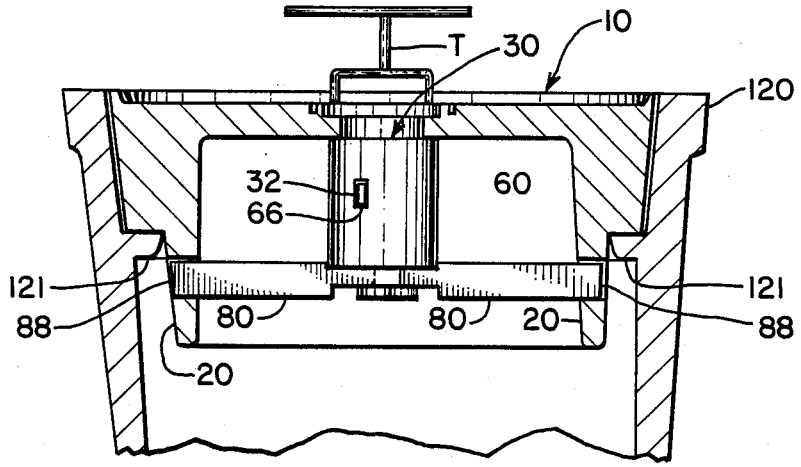
FIG. 7 is a side cutaway view of the locking valve cover in a typical valve receptacle, showing the locking lugs in a retracted position so as to disengage the valve receptacle.

Unlocking of the valve cover device 10 is accomplished by counterclockwise rotation of crank 60, as indicated by arrow 73 in FIG. 5, which causes retraction of locking lugs 80 so that their distal ends 88 extend no further than the outer perimeter of lower ring 20, as shown in FIG. 5. This counterclockwise rotation from the locked position of FIG. 4 to the unlocked position of FIG. 5 is resisted initially by the spring 100. However, as rotation of crank 60 continues in the direction of arrow 73 to where bolt 91 crosses the spring center line 74, it starts to push rotation in that direction. As rotation in the direction 73 continues, the lugs 80 are retracted until their distal ends 88 no longer protrude beyond ring 20 in FIG. 5 and are no longer under valve cover seat collar 121, as shown in FIG. 7, so the valve cover body 11 can be removed from valve box 120 as desired. When the lugs 80 are fully retracted, as shown in FIG. 5, the proximal ends 87 of lugs 80 butt against lateral surfaces 89 of adjacent lugs 80, which defines the motion limit in that direction. Spring 100 now tends to bias the mechanism in this unlocked position.

The lugs 80 do not bind-up in the holes 21 of ring 20 during retraction in the direction 73, as they do to limit movement in the direction 70 as described above, because the angled or beveled end portions 81 on one side of the lugs 80 allow sufficient twisting of the lugs 80 upon retraction to be withdrawn. Of course, the holes 21 could be made big enough to not require the bevelled end portion 81, but then the beneficial binding at points 50, 51 in FIG. 4 to limit direction 70 motion would not be available, and some other motion limiting means would have to be provided.

In operation, the dust cover 33 is first removed, and then a key K is inserted into the keyed lock cylinder 31 according to FIGS. 1 and 2. The key K is used to actuate the lock cylinder 30 so as to extend tongue 32 through both apertures 43 and 61 of the rotor cup 40 and crank 60. When lock cylinder tongue 32 engages both rotor cup 40 and crank 60, as shown in FIG. 3, rotation of rotor cup 40 will also cause crank 60 to rotate to the same extent. This rotation of rotor cup 40 can be accomplished either by turning key K, or, preferably, by inserting a rotation tool T into pivoting tool receptacles 41, 42, as described above, and rotating said rotation tool. According to FIG. 4, which shows the locking lugs 80 in the fully extended (locked) position, rotation of locking lug cam 60 by approximately ¼ turn counterclockwise will cause retraction of the locking lugs 80 to the position shown in FIG. 5. The valve cover body body 11 can then be removed from the valve box 120, as described above in relation to FIG. 7.

Securing of the locking valve cover 10 is completed by reversing the operation, i.e., by using tool T to rotate rotor cup 40 and crank 60 until the lugs 80 extend radially outward to the locked position under the shoulder 121 of valve box 120, as shown in FIG. 5. Then the key K is rotated in lock cylinder 31 so as to withdraw the tongue 32 from the aperture 61 of the crank 60, according to FIG. 2. With the tongue 32 thus disengaged from crank 60 in this manner, rotation of the rotor cup 40 by tool T or other means only causes it to spin in chamber 63 of crank 60, but it will not retract the locking lugs 80, and the locking valve cover 10 is locked and secured. Tongue 32 retains lock cylinder 32 in place, preventing unauthorized access to the apertures 61 and 43, and thereby to rotation of the locking lug cam 60.

Protection of the locking valve cover 10 from opening by prying tools is provided by the relatively tight fit between shoulder 19 of valve cover 10 and the valve box according to FIG. 6. Further protection is provided in that, according to FIG. 1, the depth of recessed lifting point 12 of valve cover body 11 does not extend the whole depth of shoulder 18 according to FIG. 2, but only to a depth of approximately one to two inches below the upper flat surface of portion 14 of valve cover body 11. Retention of lock cylinder 31 in cam actuator 40 by projection of lock cylinder tongue 32 into aperture 43, according to FIG. 2, protects the locking mechanism 30 from access by prying tools.

Removable cap 33, which may be made of a suitably resilient material, such as polyethylene, is placed as shown in FIGS. 2 and 3, so as to protect the locking mechanism 30 from dirt, debris, and ice. It is pried off when access is required to locking mechanism 30.

The design of the locking lugs 80 is such that they may secure the locking valve cover 10 in a number of pipe assemblies or shrouds that differ significantly from that shown in FIGS. 6 and 7. For example, locking lugs 80 could as easily engage holes in pipe 120, rather than the lip or shoulder as shown at 121.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention as defined by the claims which follow.

The embodiments of the invention in which an exclusive property or privilege is claimed are defined as follows:

1. In locking cover apparatus, wherein the cover is comprised of a top plate positioned on, and closing the top end of a downwardly extending ring, and a plurality of radially moveable, elongated lugs positioned under the top plate and extending radially through respective holes through the ring, the improvement comprising:

a rotatable driver extending through, and rotatably mounted in, a hole in the top plate;

crank means under said top plate and adjacent said rotatable driver and connected to said lugs for radially extending and retracting said lugs in relation to said rings, and lock means positioned in said driver and accessible and operable from above the top plate for releasably connecting said driver to said crank means.

2. In locking cover apparatus, wherein the cover is comprised of a top plate positioned on, and closing the top end of a downwardly extending ring, and a plurality of radially moveable, elongated lugs positioned under the top plate and extending radially through respective holes through the ring, the improvement comprising:

a rotatable driver extending through, and rotatably mounted in, a hole in the top plate, wherein said rotatable driver has an upper portion and a lower portion, the upper portion of which is rotatably mounted to said top plate and the lower portion of which extends downwardly through said hole in said top plate;

crank means under said top plate and adjacent said rotatable driver and connected to said lugs for radially extending and retracting said lugs in relation to said ring, wherein said crank means is connected in rotatable relation to said lower portion under said top plate; and lock means positioned in said driver and accessible and operable from above the top plate for releasably connecting said driver to said crank means, wherein said lock means has releasable latch means operable from above said top plate for releasable latching said driver and said crank means together in rotatably immovable relation to each other so that rotation of said driver with respect to said top plate also causes rotation of said crank means with respect to said top plate, said lugs being connected to said crank means in such a manner that rotation of said crank means in one direction radially extends said lugs and rotation of said crank means in the opposite direction radially retracts said lugs.

3. The improvement of claim 2, wherein said driver is in the form of a cylindrical cup having cylindrical sidewalls, an open top end, and a closed bottom end, the top of which cup is rotatably mounted to said top plate and the sidewalls and bottom of which cup extend below said top plate, said crank means is also cylindrical in shape and has cylindrical sidewalls, an open top, and a closed bottom, the cylindrical walls of said crank means being just large enough for said cylindrical driver cup to be positioned concentrically therein and rotatable with respect thereto and too large to pass through said hole in said top plate, said bottom of said driver cup and said bottom of said crank means being fastened together in such a manner as to prohibit axial movement while allowing rotatable movement of said driver cup in relation to said crank cylinder.

4. The improvement of claim 3, wherein said driver cup has an aperture in its cylindrical sidewall, said crank cylinder also has an aperture in its cylindrical sidewall that is radially alignable with the aperture in the driver cup sidewall, and said latch of said lock means includes a radially extendable and retractable tongue aligned with said apertures in the driver cup sidewall and in the crank cylinder sidewall and actuatable by said lock means.

5. The improvement of claim 4, wherein said tongue is an integral part of said lock means and said lock means can be actuated from above said top plate to retract said tongue out of said aperture in said crank cylinder sidewall but not out of said aperture in said driver cup sidewall so that said lock means cannot be removed from said driver cup by actuation of said tongue from above the top plate.

6. In locking cover apparatus, wherein the cover is comprised of a top plate positioned on, and closing the top end of a downwardly extending ring, and a plurality of radially moveable, elongated lugs positioned under the top plate and extending radially through respective holes through the ring, the improvement comprising:

a rotatable driver rotatably mounted under the top plate;

a crank positioned under said top plate and adjacent said rotatable driver, said crank being rotatable about an axis, said lugs being connected at their proximal ends to said crank eccentric to said axis and with the distal ends of said lugs positioned in respective ones of said holes through said ring such that rotation of said crank about said axis moves the distal ends of said lugs radially with respect to said axis and with respect to said ring, said lugs being beveled on one lateral side adjacent the distal ends, said beveled side defining a beveled face perpendicular to the plane of extension of said lugs, and the clearance between said lugs and the ring in said holes being close enough such that the lug goes into a bind with the ring and cannot be withdrawn from the ring when forced one direction by said eccentric mounting to the crank, but not close enough to cause such a bind with the beveled side when forced in the opposite direction so that they can be withdrawn by rotating the crank about the axis in the opposite direction; and lock means positioned in said driver and accessible and operable from above the top plate for releasably connecting said driver to said crank.

7. In locking cover apparatus, wherein the cover is comprised of a top plate positioned on, and closing the top end of a downwardly extending ring, and a plurality of radially moveable, elongated lugs positioned under the top plate and extending radially through respective holes through the ring, the improvement comprising:

a rotatable driver rotatably mounted under the top plate;

crank means under said top plate and adjacent said rotatable driver and connected to said lugs for radially extending and retracting said lugs in relation to said ring, wherein said crank means is rotatable about an axis and there are at least three lugs each of said lugs being connected at its proximal end to said crank means eccentrically with respect to said axis and in the same plane, which is perpendicular to the axis, and with the distal end of each lug positioned in one of said holes through said ring, said lugs being long enough so as not to have their distal ends completely withdrawn from said holes in said rings when said crank means is rotated about said axis enough to bring the proximal end of one lug into contact with the side of the next adjacent lug; and lock means positioned in said driver and accessible and operable from above the top plate for releasably connecting said driver to said crank means.

8. In a valve cover having a top portion and a side wall portion, and having a locking mechanism comprising locking lugs that engage retention means in a pipe, the improvement comprising:

said valve cover having a central hole in said top portion for mounting a locking mechanism within;

guide holes within said side walls for receiving said locking lugs;

a rotor and a crank, each of which has an aperture that can be engaged so as to turn the locking lugs into and out of a locked position;

a locking cylinder having engaging means for simultaneously engaging said aperture of said rotor and said crank so as to rotate both simultaneously, said engaging means being able to disengage the aperture of said rotor from the aperture of said crank so that said crank cannot rotate to disengage said locking lugs.

9. The improvement of claim 8 wherein said locking lugs are held in the selected position by overcentering means that exerts a pressure to fully extend and fully retract said locking lugs.

10. The improvement of claim 8 wherein said engaging means comprises the tongue of a lock cylinder.

11. The improvement of claim 8 wherein said rotor is a cylinder having a side wall, a closed lower portion, and an open upper portion that form a chamber portion for receiving said locking cylinder, and having an aperture in said side wall for receiving said engaging means of said locking cylinder means.

12. The improvement of claim 8 wherein said crank is a cylinder having a side wall, a closed lower portion, and an open upper portion that form a chamber portion for receiving said rotor and said locking cylinder means, and having an aperture in said side wall for receiving said engaging means of said locking cylinder means, said crank being rotatably attached to said rotor, and said locking lugs being rotatably attached to said crank eccentric to the axis of rotation of said crank.

13. The improvement of claim 8 wherein said locking lugs are eccentrically mounted to said crank and are slideably retained by guide holes within the valve cover.

14. The improvement of claim 13 wherein said locking lugs have a bevel on one side adjacent the distal end so that the locking lugs bind in said guide holes of said valve cover to prevent retraction by the crank rotating in one direction.

15. The improvement of claim 8 wherein said rotor has an upper flange portion that rests on an upper side of said top portion of said valve cover, and said crank has an upper portion that is positioned adjacent a lower side of said valve cover so that, when assembled, said flange portion of said rotor and said upper portion of said crank sandwich said top portion of said valve cover on its upper and lower sides, thereby mounting and retaining said rotor and said crank in place.

16. The improvement of claim 8 wherein said rotor has receiver means for insertion of a rotating tool for rotating said rotor.

17. A method for locking valve covers that are adapted for placement of said valve covers in receiver means such as a pipe, said receiver means having retention means, the method comprising the steps of:

locking said valve cover by rotating a lock cylinder so as to extend a lock cylinder tongue through apertures in a rotor and a crank, so that said rotor and said crank rotate as a unit;

rotating said rotor so as to rotate said crank, in turn moving locking lugs radially into a fully extended position;

engaging retention means by said locking lugs so that the valve cover is held forcibly in place by said locking lugs; then securing said valve cover by rotating said lock cylinder in a direction so as to disengage said lock cylinder tongue from the aperture of said crank so that the crank no longer rotates as a unit with said rotor, and rotation o said rotor will not in turn retract said locking lugs.

18. The method of claim 17, including the steps of:

unlocking said valve cover by rotating a lock cylinder so as to extend a lock cylinder tongue through apertures in said rotor and in said crank, so that aid rotor and said crank rotate as a unit;

rotating said rotor so as to rotate said crank in a direction that retracts said locking lugs so that said locking lugs disengage from said retention means, enabling extraction of said locking valve cover from said receiver means.

19. The method of claim 17 including the step of projecting locking lugs through holes in the side wall of said valve covers.

20. The method of claim 17, including the step of holding said locking lugs in the extended, locked, position by force from an overcentering spring.

21. The method of claim 18, including the step of holding said locking lugs in the retracted, unlocked, position by force from an overcentering spring.

22. The method of claim 18, including the step of holding over-rotation of locking lugs in the retracted position by contacting one locking lug with an adjacent locking lug.

23. The method of claim 17, including the step of preventing over-rotation of locking lugs in the extended position by binding said locking lugs in said holes in the side wall of the valve cover.

* * * * *

UNITED STATES PATENT AND TRADEMARK OFFICE

CERTIFICATE OF CORRECTION

PATENT NO. : 4,902,165
DATED : February 20, 1990
INVENTOR(S) : Lewis A. Embree

It is certified that error appears in the above—identified patent and that said Letters Patent is hereby corrected as shown below:

In column 12, line 1, change "rotation o" to --rotation of--.

In column 12, line 6, change "that aid" to --that said--.

Signed and Sealed this

Eighth Day of January, 1991

*Attest:*

HARRY F. MANBECK, JR.

*Attesting Officer*

*Commissioner of Patents and Trademarks*